US009676530B2

(12) United States Patent
Cotton

(10) Patent No.: US 9,676,530 B2
(45) Date of Patent: Jun. 13, 2017

(54) STORAGE CONTAINER

(71) Applicant: TLC Design Limited, London (GB)

(72) Inventor: Tom Cotton, London (GB)

(73) Assignee: TLC Design Limited, London (GB)

( * ) Notice: Subject to any disclaimer, the term of this patent is extended or adjusted under 35 U.S.C. 154(b) by 0 days.

(21) Appl. No.: 14/651,847

(22) PCT Filed: Dec. 13, 2013

(86) PCT No.: PCT/GB2013/000549
§ 371 (c)(1),
(2) Date: Jun. 12, 2015

(87) PCT Pub. No.: WO2014/091188
PCT Pub. Date: Jun. 19, 2014

(65) Prior Publication Data

US 2015/0321807 A1 Nov. 12, 2015

(30) Foreign Application Priority Data

Dec. 13, 2012 (GB) ..... 1222477.0

(51) Int. Cl.

| | |
|---|---|
| ***B65D 51/16*** | (2006.01) |
| ***B65D 51/24*** | (2006.01) |
| ***B65D 85/72*** | (2006.01) |
| ***B65D 41/00*** | (2006.01) |
| ***A47G 19/12*** | (2006.01) |
| ***B65D 81/24*** | (2006.01) |
| *B65D 8/00* | (2006.01) |
| *B65D 21/08* | (2006.01) |
| *B65D 83/00* | (2006.01) |

(52) U.S. Cl.
CPC ..... *B65D 51/1644* (2013.01); *A47G 19/12* (2013.01); *B65D 41/005* (2013.01);
(Continued)

(58) Field of Classification Search
CPC .. B65D 51/1644; B65D 41/005; B65D 51/24; B65D 51/1616; B65D 85/72;
(Continued)

(56) References Cited

U.S. PATENT DOCUMENTS 1,699,873 A * 1/1929 Brodsky ..... B65D 83/0027 210/359
2,341,031 A * 2/1944 Flynn ..... B65D 83/0044 222/320

(Continued)

FOREIGN PATENT DOCUMENTS

DE 19858576 A1 6/2000
EP 2537775 A1 12/2012

(Continued)

OTHER PUBLICATIONS

International Search Report dated Mar. 25, 2014, from corresponding International Application No. PCT/GB2013/000549.

*Primary Examiner* — Robert J Hicks
*Assistant Examiner* — Kareen Thomas
(74) *Attorney, Agent, or Firm* — Quine Intellectual Property Law Group P.C.

(57) ABSTRACT

A storage device (10) comprising a receptacle (12) and a movable closure member (22), the closure member comprising a seal (30) about its periphery, for positioning against the inside of the receptacle, and a valve (32) within its periphery, wherein the closure member can be moved within the receptacle such that its periphery is substantially continually in contact with the internal surface of the receptacle, and wherein, when in an open position, the valve allows flow of fluid from within the receptacle through the valve, and when in a closed position, the valve prevents flow of liquid from within the receptacle, wherein the receptacle is substantially closed at its lower end.

15 Claims, 10 Drawing Sheets

(52) U.S. Cl.
CPC ..... *B65D 51/1616* (2013.01); *B65D 51/24* (2013.01); *B65D 81/245* (2013.01); *B65D 85/72* (2013.01); *B65D 11/04* (2013.01); *B65D 21/08* (2013.01); *B65D 83/0044* (2013.01)

(58) Field of Classification Search
CPC .. B65D 81/245; B65D 83/0044; B65D 11/04; B65D 21/08; A47G 19/12
USPC ..... 220/216–227
See application file for complete search history.

(56) References Cited

U.S. PATENT DOCUMENTS 3,987,941 A * 10/1976 Blessing ..... A47J 36/06 220/578
4,471,892 A * 9/1984 Coleman ..... B65D 88/60 220/578
6,010,036 A * 1/2000 Bougamont ..... B65D 83/0044 222/183
6,290,105 B1 9/2001 Cosentino
8,177,088 B1 5/2012 Williams
2005/0061764 A1 3/2005 Tamashiro
2008/0190933 A1 8/2008 Bougon
2011/0278297 A1 11/2011 Corti
2011/0290826 A1 12/2011 Harris

FOREIGN PATENT DOCUMENTS

GB 2508862 A 6/2014
GB 2508999 A 6/2014
JP H8717572 A 1/1995
WO WO 2011/101511 A1 8/2011

* cited by examiner

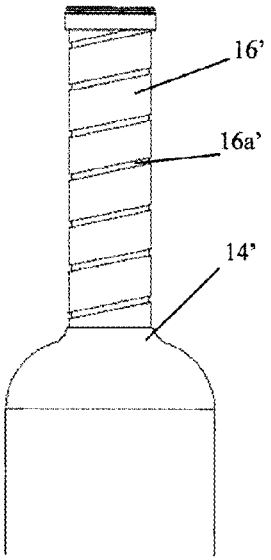
Fig. 15
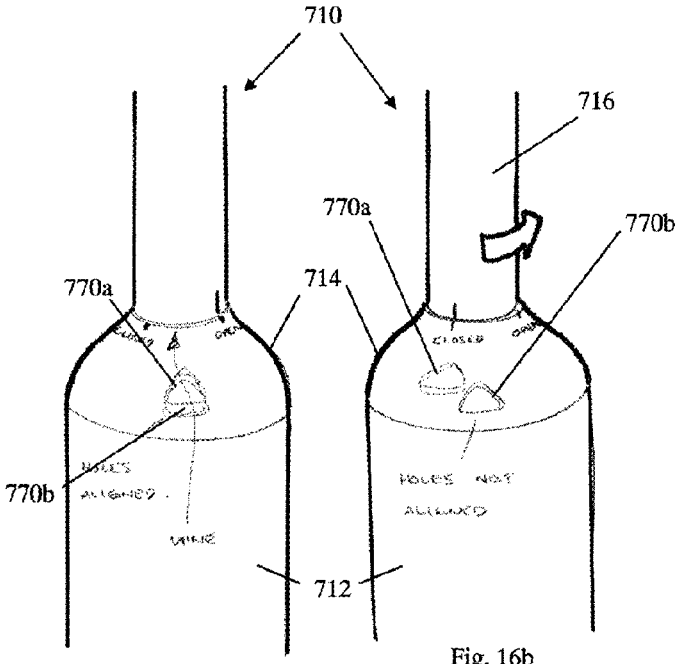
Fig. 16a
Fig. 16b
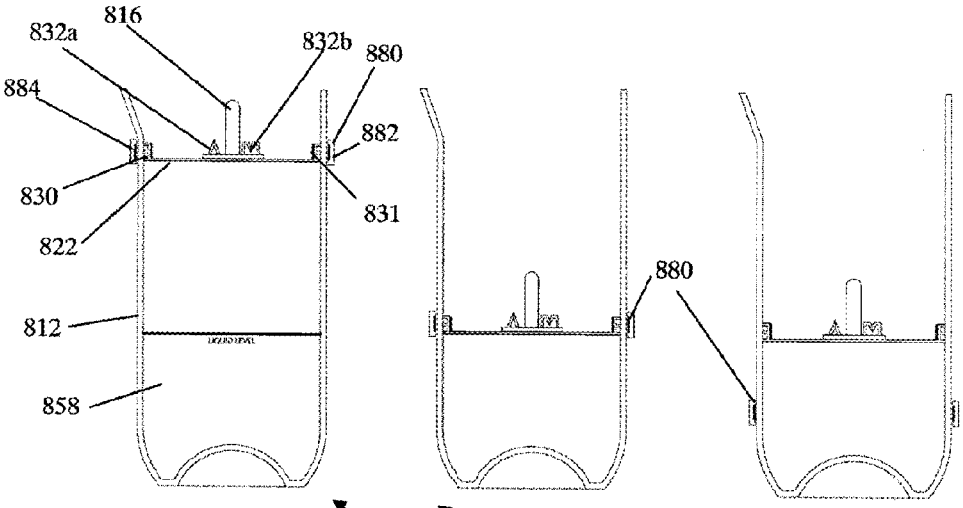
Fig. 17a
Fig. 17b
Fig. 17c

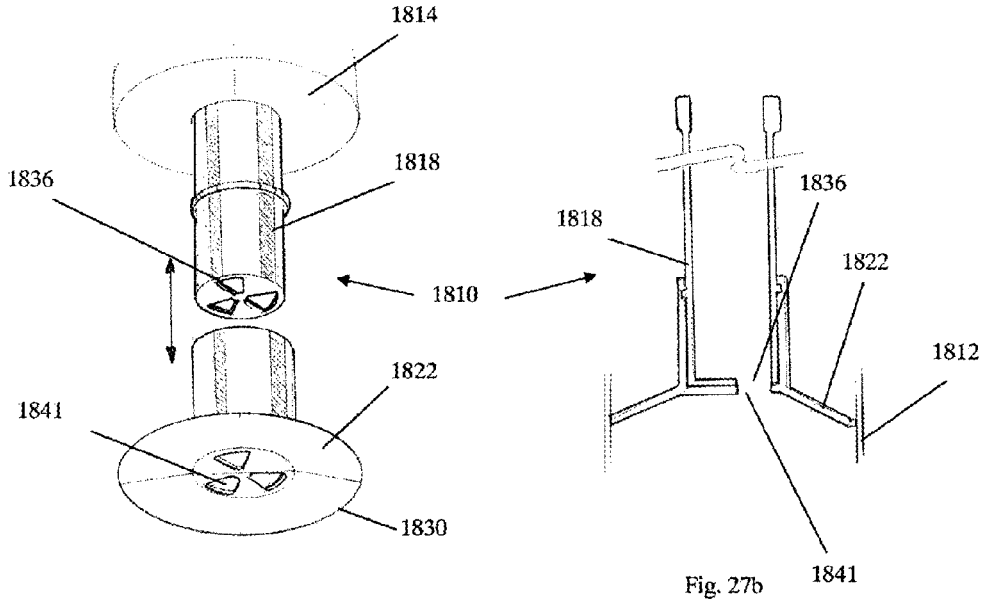
Fig. 27a
Fig. 27b
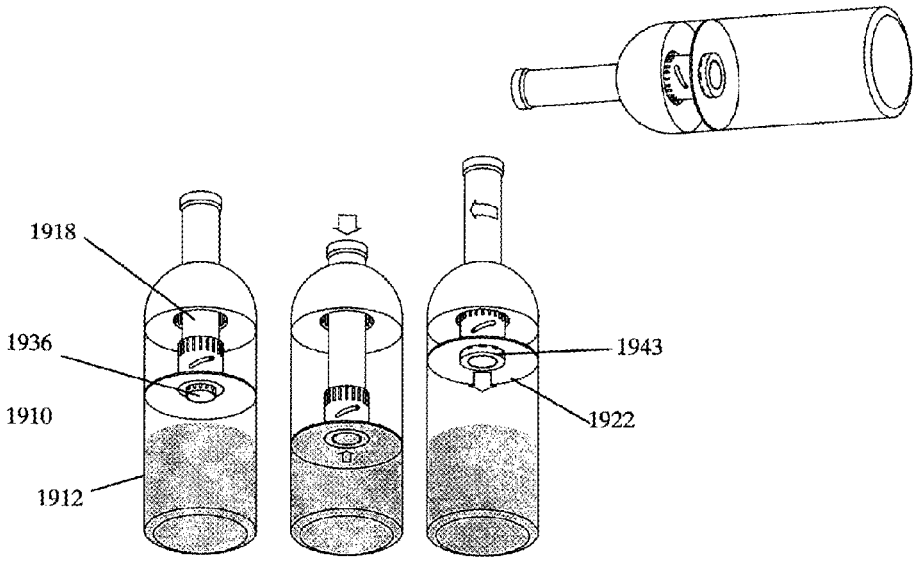
Fig. 28

STORAGE CONTAINER

FIELD OF THE INVENTION

This invention relates to a storage container, especially for use with liquids.

BACKGROUND TO THE INVENTION

Food and drink products are known to deteriorate when in contact with air for an extended period. In particular, wine and oil, especially olive oil, are known to lose their flavour and to oxidise swiftly in the presence of air. Therefore, there is an underlying desire to keep air from coming into contact with liquids when they are being stored. Usually, when bottled wine or oil is opened it remains in its bottle and any air in the bottle remains in place, thereby contributing to the rancidification of oil and the oxidation of wine.

Additionally, once the contents of glass bottles has been used, the bottle is usually thrown away, although it can be recycled. Therefore, there is a desire to re-use bottles in order to reduce the amount of glass waste.

SUMMARY OF THE INVENTION

Accordingly, the present invention is directed to a storage device comprising a receptacle and a movable closure member, the closure member comprising a seal about its periphery, for positioning against the inside of the receptacle, and a valve within its periphery, wherein the closure member can be moved within the receptacle such that its periphery is substantially continually in contact with the internal surface of the receptacle, and wherein, when in an open position, the valve allows flow of fluid from within the receptacle through the valve, and when in a closed position, the valve prevents flow of liquid from within the receptacle, wherein the receptacle is substantially closed at its lower end.

The receptacle is substantially closed at its lower end such that the liquid can only pass through the upper end of the device. As such the only outlet is at the upper end of the device. The movable closure member allows one to provide a seal at whatever the liquid level is at within the receptacle. Additionally, the use of at least one valve in the device allows for the air to be removed from above the liquid as the closure member is moved towards its upper surface. Using a particular type of valve, the closure member can then be sealed to prevent the escape of liquid through the closure member, thereby allowing for a fluid impermeable seal to be established. Air and liquid can escape when the valve is in an open position but once the air is removed, the valve closes and the liquid cannot escape from the receptacle.

An advantage of the present invention is that it can be used as a refillable vessel. By having a central location for distributing liquids, such as oil, vinegar and/or wine, the present invention can be repeatedly filled as necessary, thereby reducing the reliance on glass bottles that are often thrown away. In such circumstances, the device creates a green alternative to the use of glass and/or disposable vessels.

Preferably, when the movable closure member is positioned at the top level of the liquid, it self-limits further motion towards the liquid and it cannot be moved any lower. Because the valve allows air to escape when in a close position, but it does not allow the passage of liquid through, when the closure member is positioned against the meniscus of the liquid, the air is able to escape but not the liquid.

Therefore, the closure member cannot move any further down and is self-limited, or self-sealing, because the valve is locked. As liquid cannot be compressed, the valve is essentially acting against an incompressible body and so is limited in its movement. If any air is caught within the receptacle and below the movable closure member, it can be compressed and will either find its way to the valve and escape, or it will comprise a reduced volume and thereby be in contact with less liquid than it otherwise would have been.

Advantageously, the closure member comprises an adjustment section for adjusting the position of the closure member within the receptacle. The adjustment section may be permanently attached to the closure member or it may connect to the closure member only to change its position.

It is preferable that the adjustment section is integral with the closure member. The closure member may comprise an elongate member attached to the movable closure member for longitudinal movement within the receptacle. Thus, when the position of the elongate member is changed, the position of the closure member changes accordingly. This may create a piston and cylinder arrangement, or a plunger-like arrangement.

In an advantageous embodiment, the adjustment section comprises a conduit therethrough, thereby allowing fluid communication from within the receptacle, through the valve and through the adjustment section to outside the device. In such an arrangement, the adjustment section can allow the flow of the contents of the receptacle to pass through when the valve is open. This allows one to pour the liquid through the valve and subsequently through the adjustment section. As a result, the adjustment section and closure member do not need to be completely removed from the receptacle before the liquid is dispensed.

In a first embodiment, the movable closure member comprises an aperture and the valve comprises a blocking member that, in a closed position, is received within the aperture and closes the aperture to the passage of fluid. The valve may comprise a passage through which fluid can pass but that can be closed by way of a blocking member. The blocking member is able to move within the valve from an open position to a closed position.

Preferably, the blocking member comprises a float that, when it comes into contact with liquid contained within the receptacle, floats thereupon and blocks the aperture of the closure member. By having a float with a density lower than that of the liquid within the receptacle, when the float comes into contact with the liquid it will be raised towards the closure member as the closure member is moved towards the liquid. As the float raises, it can be moved into the fluid flow path through the valve, and it can close the aperture to the passage of fluid therethrough. As a result, the valve closes upon contacting the liquid. Additionally, the more that the closure member is forced towards the liquid, the tighter that the valve is closed more tightly, thereby increasing the self-limiting nature of the device.

More preferably, valve comprises a ball float. The use of a ball float allows for a practical seal to be created between the ball float and the aperture of the valve and it reduces the risk of the float adhering to the aperture as it might in other configurations.

It is advantageous that the float comprises a weight. The use of a weight or weighted portion within the float allows the float to pull away from the aperture and conduit when the valve is intended to be in an open position, especially when the receptacle is in an upright position. Liquid passing through the aperture of the valve may increase the likelihood of the float adhering to the aperture of the valve. Use of a weight within the float aids with disengaging the float when required.

In a preferred embodiment the aperture has tapered sides. The use of tapered sides to the aperture allows for a more reliable seal to be established. Additionally, the tapering provides a smoother flow of fluid through the closure member.

In a second embodiment the valve comprises a gas permeable membrane that is impermeable to liquid. The use of a selectively permeable membrane allows one to reduce the number of moving parts within the device. As the closure member is lowered, air is able to pass through the valve. However, once the valve is in contact with the liquid, it becomes self-limiting and cannot be lowered any further. An additional cap or closure device may be used to seal up the valve to further reduce the amount of air that can contact the liquid.

It is advantageous that the closure member is provided with perforations. This allows for the liquid contained in the receptacle to be able to pass through the closure member without needing to remove it first. Additionally, the use of perforations can act as a filter to remove sediment or particles from the liquid. Alternatively, or in addition, a separate filter may be attached to the closure member.

Preferably, the closure member is provided with a top membrane. An impermeable top membrane can be provided over the perforations of the closure member to prevent the passage of liquid through the closure member. This ensures that air can be cut-off from accessing the liquid in the receptacle through the perforations.

Advantageously, the membrane is flexible. The use of a flexible member to close the perforations allow them to be closed quickly and efficiently, thereby allowing easy opening and closing of the liquid passage through the closure member.

It may be preferably, for a secondary valve to be positioned above the first valve, and such a secondary valve may comprise silicone material. The use of a secondary valve above the first, which may be a duck-billed valve, further reduces the risk of ingress of air into the liquid and also reduces the risk of the device leaking when stored on its side.

It is advantageous that the closure member comprises a first portion and a second portion, rotatable relative to one another and each provided with a hole therethrough, wherein, when the holes are aligned, fluid communication is permitted between one side of the closure member and the other side thereof, and when the first portion and second portion are rotationally offset, fluid communication between one side of the closure member and the other side thereof is prohibited. Such an embodiment allows for the closure member to prevent the passage of liquid when in a closed position and to be rotated to an open position to permit the passage of liquid therethrough. This allows one to substantially open and close the storage device by rotation in addition to, or rather than, longitudinal motion.

Preferably, the device is provided with a top portion that fits onto and substantially closes the top of the receptacle. The use of a lid assists with locating the closure member within the device, particularly when the closure member is connected to an integral adjustment section that extends towards the top of the receptacle. Additionally, it provides protection to the closure member. Furthermore, it reduces the risk of the closure member being pushed down at an angle and getting stuck. The movement of the closure member may be concentric and centrally aligned to the top portion, which may be a lid, thereby improving reliability and making the device easier to operate.

Advantageously, fluid communication is allowed between the inside of the receptacle the outside of the top portion. This allows for the liquid to be poured through a conduit in the top portion without first needing to completely remove the closure member from within the receptacle.

It is desirable that the storage device is a decanter for storing wine, sparkling wine, vinegar, soft drinks and/or oil.

It is preferable that the valve of the device comprises a seat portion in which the float of the float valve rests when the receptacle is in an upright position and that wherein the seat protrudes extends beyond the lower surface of the closure member. With the seat member protruding from the closure member, it becomes easier to inspect and clean the valve and any float therein. Additionally, it allows for configurations that allow the liquid in the receptacle to be poured around the float when the liquid level in the receptacle is low.

Advantageously, the seat is provided with at least one aperture in its base and/or at least one aperture in its circumference. When in a substantially upright position, having an aperture in the base of the seat allows the fluid to 'push' the float into the aperture from the moment that the liquid level is sufficiently high. This allows the valve to be closed at the earliest opportunity because the float floats on the liquid as soon as it enters the base of the seat. This earliest opportunity may be when there is no further are below the sealing point and this the float contacts the liquid and floats on the surface thereof to close the aperture. Where the seat has at least one aperture in its circumference, this can be useful in extracting the last of the liquid from the receptacle because, when poured on an angle below horizontal, the contents can pass around the float and thus the float moves out of the aperture by floating on the liquid. Therefore, small amounts of liquid can be poured from the receptacle.

It is further advantageous that the seat has at least one aperture and the at least one aperture comprises a filter. Providing a filter in the apertures allows the liquid to be filtered as it is poured. This can be particularly important when wine that contains sediment is put into the receptacle. In such a situation, the receptacle is a decanter and filtering reduces the risk of an unpalatable mouthful of sediment from the wine.

In one embodiment, the float may move longitudinally and/or latitudinally within the valve when liquid is poured therethough. This assists with aeration of the liquid being poured through the valve and, especially in the case of wine, this can help to improve the flavour of the liquid as it is poured out. The closure member and valve may also be provided with rifling and other means to assist in further aerating the liquid as it is poured.

The junction at the aperture within the value, where the float meets the aperture when engaged, may be provided with 'springs' or temporarily deformable portions that reduce deform when the float is engaged and force the float out of the aperture when the force created by the float floating on the liquid in the receptacle is removed.

The value, float and the seat associated therewith may be formed so as to be held in a cartridge that can be removed from the rest of the assembly. This allows the valve section to be replaced should there be an issue with the mechanism, without having to replace the whole device. The cartridge may be provided with filters either at its upper or lower end.

BRIEF DESCRIPTION OF THE DRAWINGS

Embodiments of the invention will now be described, by way of example only, and with reference to the accompanying drawings, in which:

FIG. 15 shows a further aspect of the present invention;

FIGS. 16*a* and 16*b* show a view of another aspect of the present invention;

FIGS. 17*a* to 17*c* show a view of an eighth embodiment of the present invention;

FIGS. 27*a* and 27*b* show another embodiment of the present invention; and FIG. 28 shows a further embodiment of the present invention.

DETAILED DESCRIPTION OF EXEMPLARY EMBODIMENTS

Figure 1:
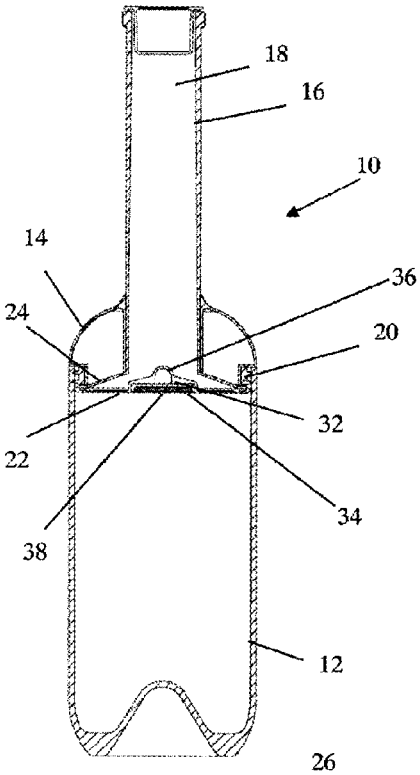
FIG. 1 is a diagram showing a decanter in accordance with a first embodiment of the present invention.
Figure 3:
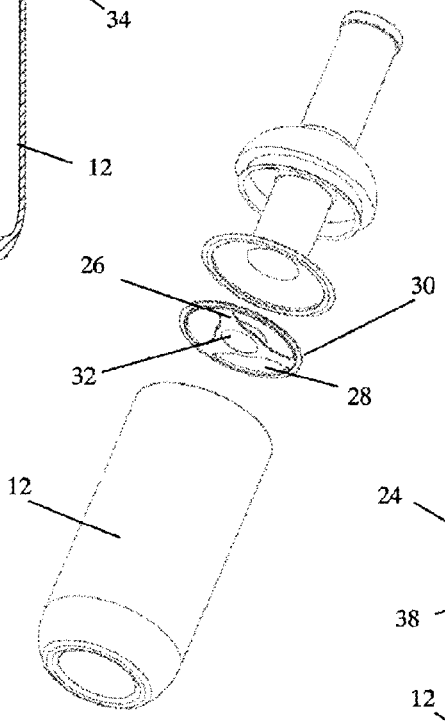
FIG. 3 is an exploded view of the decanter of FIGS. 1 and 2.
Figure 2:
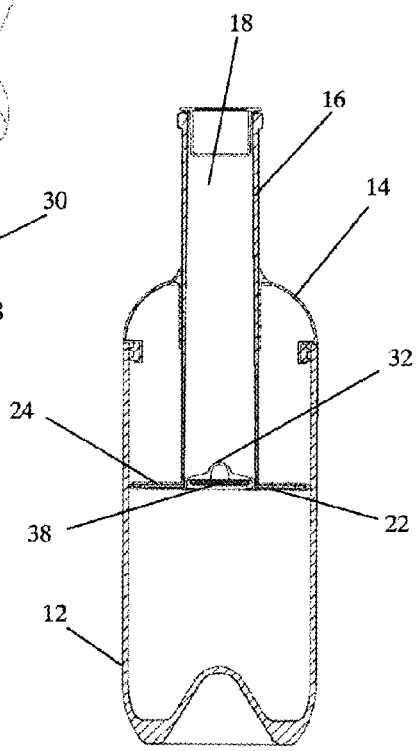
FIG. 2 is a diagram of the decanter of FIG. 1 in a second position.

FIGS. 1 to 3 show a wine decanter 10 comprising a receptacle 12 having a lid 14. The lid 14 is provided with hole through which an elongate neck 16 extends, the neck 16 having a conduit 18 coaxially through its centre and allows fluid communication from the inside of the receptacle 12 to the outside when the lid 14 is in place. The neck 16 may be moved longitudinally through the hole in the lid 14 to adjust the position of the ends of the neck relative to the lid 14. The lid 14 is also provided with a plurality of silicone gripping fins 20 around its periphery that contact the inside surface of the receptacle 12, when the lid 14 is fitted therein, and assist with retaining the lid 14 in place.

The lower end of the neck 16 is connected to a closure member 22, via a fluid-impermeable flexible top sealing membrane 24. The closure member 22 comprises a disc 26 having apertures 28 therethrough and which has a silicone sealing portion 30 around its periphery, which, when inside the receptacle 12, is substantially continually in contact with the inside surface of the receptacle 12. The closure member 22 is attached to the neck 16 such that as the longitudinal position of the neck 16 is adjusted relative to the lid 14, the closure member 22 is also adjusted accordingly. The neck 16 thus constitutes an adjustment member. The neck 16 and closure member 22 effectively constitute a plunger device or a piston arrangement with the receptacle constituting a cylinder.

Due to the resistance created by the gripping sealing portion 30 when in contact with the inside surface of the receptacle 12, movement of the neck portion 16 in a substantially upward direction (away from the base of the receptacle 12) will 'open' the sealing membrane 24, as shown in FIG. 1, and pushing of the neck potion 16 in a substantially downward direction (towards the base of the receptacle 12) will 'close' the sealing membrane 24 by positioning it adjacent with, and substantially horizontal to, the disc 26, as shown in FIG. 2. In an open position, the sealing membrane 24 is extended such that it is tapered inwardly from the edges of the disc 26 to the lower end of the neck 16. This effectively forms a funnel as can be seen in FIG. 1. When in a closed position, the sealing member 24 prevents the flow of fluid through the apertures 28 of the disc 26 as it seals the apertures 28 and is held against the disc 26 by the neck 16, as shown in FIG. 2.

A valve 32 is provided in the centre of the disc 26, the valve 32 comprising an inlet 34 in fluid communication with an outlet 36 that comprises a duckbill valve. The inlet to the duckbill value 36 has a smaller diameter than that of the inlet 34. A float 38 is provided between the inlet 34 and the outlet 36 on the inlet side of the duckbill valve and is held in a valve seat 39 that allows for fluid to pass through the seat 39. The float 38 has a smaller diameter than the inlet 34, such that fluid can pass around it, but a larger diameter than the outlet 36. The float 38 is able to move longitudinally and coaxially relative to the disc 26 and can close the valve 32. Thus, the float 38 constitutes a blocking member.

When the sealing membrane 24 is in a closed position, fluid can only pass from the inside of the receptacle 12 to the outside of the receptacle 12 through the valve 32. When the sealing membrane 24 is in an open position, fluid can pass through either the valve 32 or through the apertures 28.

To use the device 10, the lid 14 is removed from the receptacle 12 and liquid is poured into the receptacle 12. The lid 14 is then positioned onto the receptacle 12 with the neck 16 extended to its upper-most position so that the closure member 22 is in close proximity to the lid 14 and within the top of the receptacle 12. The neck 16 is then lowered and the air within the receptacle 12 and above the liquid level passes through the valve 32, through the conduit 18 of the neck 16 and out of the upper end of the neck 16. As the neck 16 is pushed downwardly within the receptacle 12, the sealing member 24 closes over the apertures 28, thereby closing them to the passage of fluid. The weight of the float 38 prevents it from being forced upwards by the flow of air and closing the fluid path through the disc 26. The air is effectively removed from between the top of the liquid in the receptacle 12 and the closure member 22, thereby leaving the liquid substantially free from contact with oxygen.

When the disc 26 reaches the uppermost surface of the liquid within the receptacle 12, the float 38 remains on the surface of the liquid, due to its density being lower than that of the liquid within the receptacle 12. Any further pressure on the neck 16 causes the float 38 to be forced in an upward direction towards the valve outlet 36. Because the valve outlet 36 has a smaller diameter than that of the float 38, the float blocks the valve outlet 36 and prevents the flow of fluid through the valve and into the conduit 18. Therefore, the valve 32 is effectively closed and, due to the apertures 28 being closed by the sealing membrane 24, the disc 26 is substantially impermeable to liquid passing therethrough. Additionally, as the sealing portion 30 provides a seal around the periphery of the disc 26, the liquid cannot pass from within the receptacle to outside through or around the disc 26. Additionally, because the air above the liquid in the receptacle passes through the valve 32 before the liquid level is encountered by the float 38, substantially all of the air is removed from between the disc 26 and the liquid. Therefore, device is effectively self-limiting, or self-sealing, as the closure member 22 cannot be forced any further into the receptacle 12 as the liquid is incompressible. As a result, the liquid is less likely to spoil due to contact with air.

In order to remove the liquid from within the receptacle, the neck 16 is pulled away from the closure member 22, thereby lifting the sealing membrane 24 from the disc 26. This effectively opens the apertures 28 in the disc 26 and allows for the liquid to pass through the disc 26, along the funnel-shaped membrane 24 and into the conduit 18 of the neck 16, from which it can pass out of the top of the device 10 through the top of the neck 16. The plunger arrangement can be raised further so that the closure member is some distance from the top of the liquid level. In raising the neck 16, the blocking float 38 is uncoupled from the valve outlet 36 due to its weight. Should only some of the liquid be required, to reseal the device 10, a user pushes the neck 16 in a downward direction so that the closure member 22 and the sealing top membrane are operated as previously described.

The use of the duckbill valve at the outlet 36 reduces the risk of the liquid leaking through the disc 26 when the device 10 is stored on its side or away from a substantially vertical position.

Figure 4:
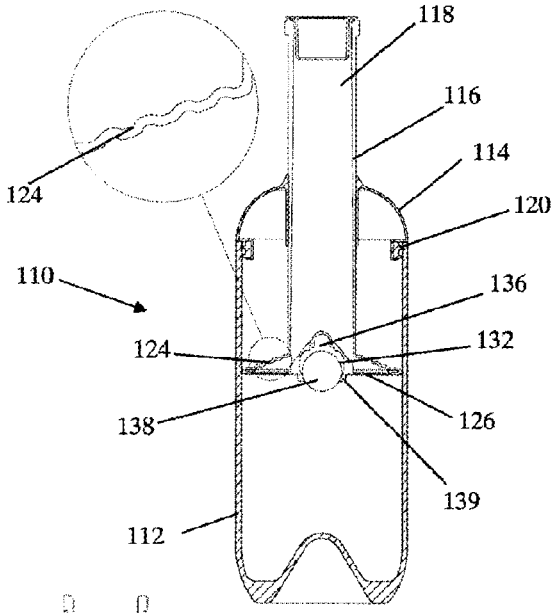
FIG. 4 is a diagram of a bottle in accordance with a second embodiment of the present invention.
Figure 5:
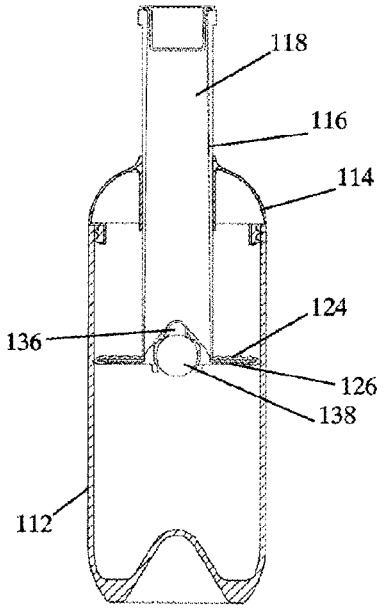
FIG. 5 is a view of the bottle of FIG. 4 in a second position.

FIGS. 4 and 5 show an arrangement similar to that shown in FIGS. 1 to 3, however, the valve 132 comprises a float 138 having a spherical, or ball, shape. The device 110 comprises a receptacle 112, a lid 114 having a neck 116, which is provided with a conduit 118. The valve arrangement 132 is provided with a more prominent float seat 139, which has a diameter less than that of the ball float 138 and thus retains it within the valve arrangement 138. The valve arrangement 132 is contoured below the duckbill valve at the outlet 136 so that the ball float 138 is accepted more easily in order to close the valve 132 and so that a more secure seal is established. The sealing membrane 124 comprises a flexible corrugated material as shown in the enlarged section of FIG. 4.

The device 110 operates in the same manner as the device shown in FIGS. 1 to 3. The use of a ball 138 in the valve arrangement 132 allows for a more reliable seal of the valve 132 and the additional weight and shape of the ball 138 reduces the risk of the float 138 adhering to the upper part of the valve 132 when the neck 116 is lifted and the valve 132 is intended to be in an open position.

Figure 6:
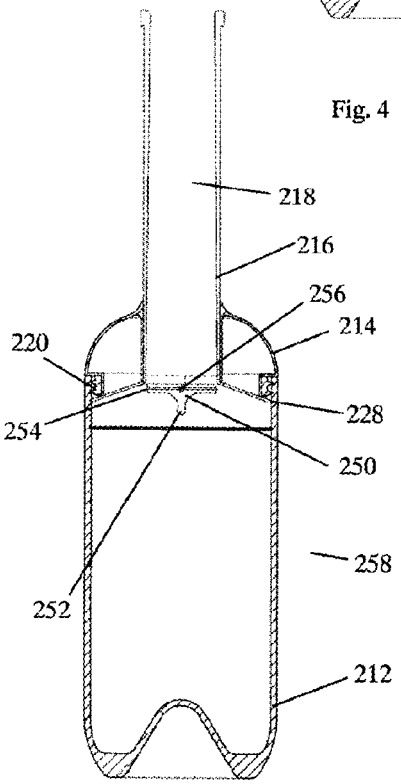
FIG. 6 is a diagram of a decanter in accordance with a third embodiment of the present invention.
Figure 7:
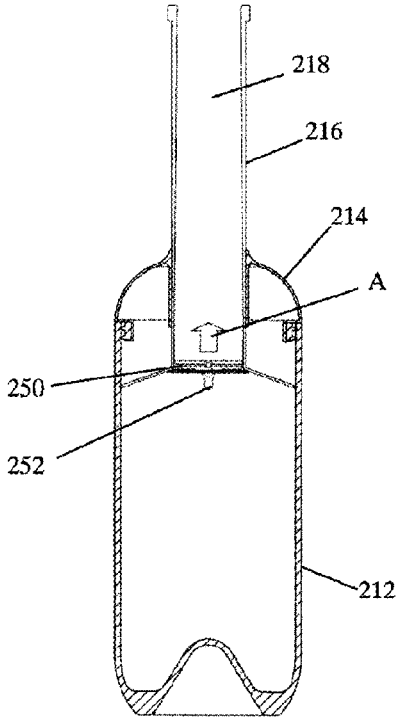
FIG. 7 is a view of the decanter of FIG. 7 in a second position.
Figure 8:
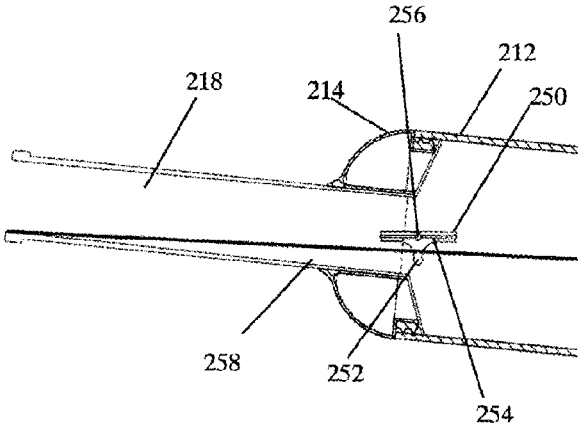
FIG. 8 is a drawing of a fourth embodiment of the present invention.

FIGS. 6 to 8 show a decanter 210 comprising a receptacle 212, having a lid 214. The lid 214 is provided with a height-adjustable neck 216 passing through its centre, the neck 216 having a conduit 218 passing through its length and connecting the inside of the receptacle 212 with the outside of the receptacle 212 in fluid communication. The lid 214 is provided with sealing fins 220 about its circumference to aid with securing it within the receptacle 212. The lower end of the neck 216 is flared such that it is tapered outwardly towards the inside surface of the receptacle 212 and it extends thereto. The periphery of the lower end of the neck 216 is provided with a silicone seal 228 in order to provide a substantially fluid-tight seal between the lower end of the neck 216 and the inside surface of the receptacle 212. The lower end of the neck 216 is therefore substantially conical, with the conduit 218 at the upper end thereof, which creates an inverted funnel shape.

The lower end of the conduit 218 of the neck 216 is provided with an adjustable closure member 222, which comprises a pivotable float disc 250 having an integral weighted stem 252 on its lower surface. The pivotable float disc 250 in combination with the lower end of the neck 216 and the conduit 218 constitutes a valve arrangement. The float disc 250 is constructed such that it has a relatively low density and is thus able to substantially float on liquid, however, the stem is weighted such that it will orientate the float disc 250 so that the upper surface of the float disc 250 is substantially horizontal regardless of the orientation of the orientation of the receptacle. The circumference of the float disc 250 is sized such that it fits within the conduit 218 and it is provided with an 0-ring seal 254 about its periphery. The pivot axis 256 of the float disc 250 is substantially vertically adjustable such that the disc float 250 can be raised and lowered into, and out of, the end of the conduit 218. The pivot axis 256 is secured at the lower end of the neck 216 and adjacent the conduit 218.

For use, liquid 258 is poured into the receptacle 212 and the lid 214 is fitted into place with the fins 220 holding it securely with the neck 216 extended upwardly (thus the closure member 222 is located near the lid 214). The neck 216 is then adjusted so that the closure member 222 is lowered to the level of the liquid 258, with air passing through the closure member 222. The funnel shape of the lower end of the neck 216 forces air towards the conduit 218, which it passes through and leaves the receptacle 212. Once the liquid 258 enters the conical lower end of the neck 216, the float disc 250 begins to be 'pushed' into the end of the conduit 218 by virtue of it floating on the surface of the liquid 258, with the weight orientating it such that it is able to 'plug' the conduit 218 and prevent fluid flow therethrough, as shown by the arrow A. Thus, the air is removed from within the receptacle and the liquid 258 is retained therein. Because the closure member 222 seals the end of the conduit 218, and the peripheral seal 228 prevents the passage of fluid around the outside of the closure member 222, further pressing of the neck 216 in a downward direction self-seals the device and no liquid can pass into the conduit 218. Therefore, the liquid is contained within the receptacle 212 with substantially all of the air removed, thereby reducing the risk of oxidation.

To pour the liquid 258 from within the device 210, the neck 216 is raised, which 'unplugs' the conduit 218 due to the weighted stem 252 'pulling' the disc float 250 from the conduit 218. The decanter is then tilted as usual and, as the weighted end 252 of the float disc 250 retains the closure member 222 in a substantially horizontal position, the liquid 258 is able to pass around the float disc 250 and through the conduit 218 out of the decanter 210. The raising of the neck 216 uncouples the float disc 250 due to the weight of the disc 250 and the negative pressure within the receptacle below the valve 222.

Any liquid 258 remaining in the decanter 210 after pouring may be re-sealed in the device 210 by lowering the neck 216 once more.

Figure 9:
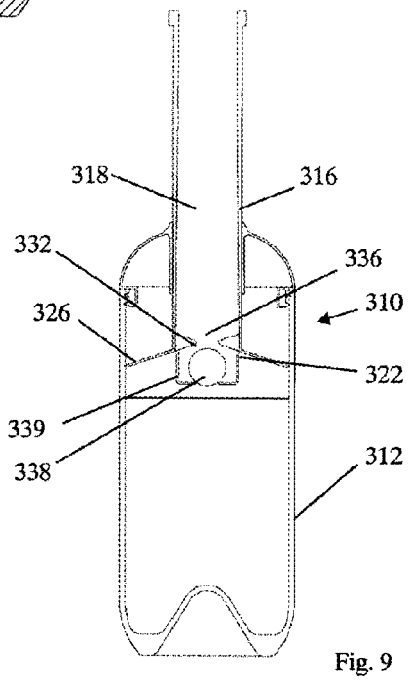
FIG. 9 is a view of the decanter of FIGS. 7 and 8 in a further position.

In the embodiment of FIG. 9, which is similar to the previously described embodiments, the device 310 comprises closure member 322 connected to a neck 316 though which passes a conduit 318. The closure member 322 comprises a substantially solid skirt 326, which has a valve 332 located in its centre. The outside of the skirt 326 is tapered upwardly from its periphery towards the valve 332 such that it effectively forms a funnel with the neck 316.

The valve 332 comprises a ball float 338 in the path of a valve outlet 336, the outlet 336 having a toroidal shape tapered towards its centre, such that the ball float 338 can engage and substantially block the aperture in the outlet 336. The ball float 338 is held in position by a valve float seat 339 that prevents it from moving too far from the outlet 336. In a similar manner to the devices 10 and 110 shown in the aforementioned figures, the ball float 338 floats when the closure member 322 contacts the liquid level and, due to the tapered nature of the valve outlet 336, is located in and blocks the aperture in the outlet 336, effectively sealing the conduit 318. The device 310 operates in a similar manner to those shown in FIGS. 6 to 8.

Figure 10:
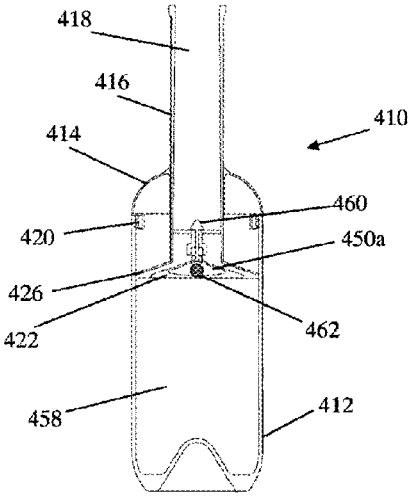
FIG. 10 is a diagram showing a fifth embodiment of the present invention.
Figure 11:
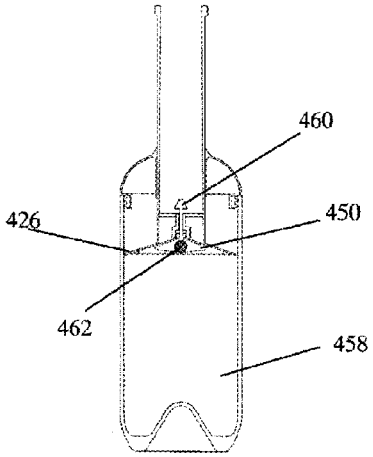
FIG. 11 is a diagram showing a second position of the embodiment shown in FIG. 10.
Figure 12:
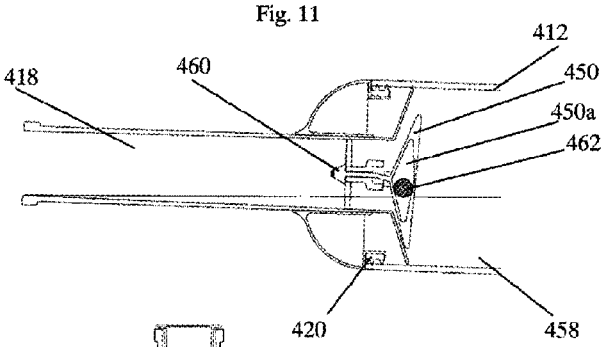
FIG. 12 is a diagram showing the embodiment of FIGS. 10 and 11 in a third position.

FIGS. 10 to 12 show a liquid storage device 410, having a similar arrangement of receptacle 412, a lid 414 and neck 416 to that shown in FIGS. 6 to 8. However, in the device 410 shown in these figures, the valve 432 in the closure member 422 comprises a different construction to the valve of the device 210 in FIGS. 6 to 8. In this fifth embodiment, the valve 432 comprises a flexible stem 460, a first end of which is held coaxially with, and adjacent the end of, conduit 418. The other end of the stem 460 is connected to a float disc 450, having a top surface shaped to match the tapering of the lower end of the neck 416. The float disc 450 comprises a central weighted section 462.

When the neck 416 and the closure member 422 are raised away from the level of the liquid 458, the weighted float disc 450 hangs down from the stem 460 and allows fluid to pass around it. Thus, when the neck 416 is lowered, the air within the receptacle 412 is able to pass into the conduit and out through the top of the neck 416. When the float 450 contacts the level of the liquid 458, due to its buoyancy, it is forced upwardly into the conduit 418 and blocks the conduit 418, thus sealing the liquid in the device 410 with substantially no air within the receptacle 412.

As the neck 416 is raised, the float disc 450 is uncoupled from within the conduit 418 due to its weight and any negative pressure within the receptacle below the valve 422. The stem 460 limits the distance that the float disc 450 can be withdrawn from the conduit 418 so that it is in place for any subsequent use. The liquid 458 can be poured around the closure member 422, which use the stem 460 and the weighted portion 452 to position it sufficiently far from the conduit 418 to allow flow of the liquid there around.

The outer edges of the float disc 450 may be provided with apertures to aid with the flow of liquid 458 through the float when the device 410 is in an open position. However, the central part of the float 450*a* is substantially impermeable to liquid.

Figure 13:
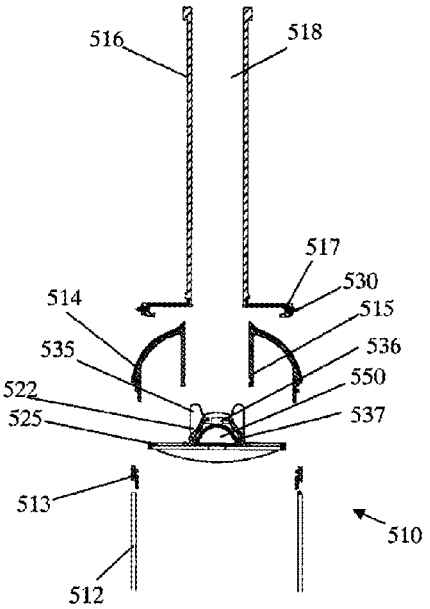
FIG. 13 shows an exploded view of a sixth embodiment of the present invention.

FIG. 13 shows a decanter 510 comprising a glass receptacle 512 and a lid 514 connected to the top of the receptacle 512 by way of a plastics receptacle connection 513 with which the lid 514 engages. The structure is similar to that shown in FIGS. 1 to 3 in that the device further comprises an adjustable neck 516 having a conduit 518 therethrough; however, the closure member 522 has a different construction from the device 10.

The closure member 522 of the embodiment shown in FIG. 13 comprises a disc 526 having at least one aperture passing therethrough and a gauze section 525 sandwiched in the middle of the disc 526. The closure member 522 comprises an outlet 536 contained within housing 535 within which is located a blocking float 550 below the outlet 536. The closure member 522 is held within connectors 517 that extend from the lower end of the neck 516. The connectors 517 are provided with sealing fins 530 to ensure a substantial seal between the closure member 522 and the inside of the receptacle 512.

The outside of the housing 535 is provided with a connection arrangement in the form of an O-ring 537 that can be received within the lower end of arms 515, which extends substantially downwardly from the lid 514. When the neck 516 is pulled upwardly to a position at which it is most protruding from the lid 514, the O-ring 537 'snaps' into the arms 515 to give tactile feedback to the user that the neck 514 is in a pour-ready position.

To seal the liquid in the device 510, the neck 516 is lowered and once the float 550 contacts the liquid contained within the receptacle 512, the outlet 536 is closed.

Figure 14:
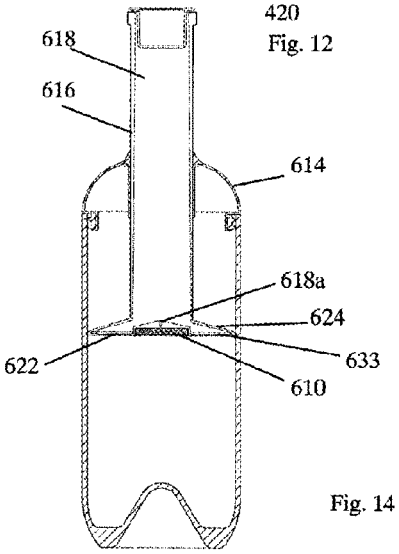
FIG. 14 is a view of a seventh embodiment of the present invention.

FIG. 14 shows a device 610 with a similar construction to the device 10 shown in FIGS. 1 to 3. The closure member 622 of this device 610 is provided with a valve 632 that comprises a layer of gas permeable material 633, which is not permeable to liquid, for example Gore-Tex® material. As a result, as the closure member 622 is lowered, gas is able to pass through the valve 632 via the material 633. However, when the valve reaches the liquid level the liquid cannot pass through the material 633 and thus the closure member 622 is prevented from moving any lower. The material 633 is provided with a duckbill valve (not shown) on top of the small conduit 618*a* to prevent the flow of air back to the liquid. Once the neck 616 is retracted and the sealing membrane 624 is pulled away from the disc 626, air and liquid can pass through the disc 626 via apertures (not shown), thereby allowing the liquid to be poured from the device 610.

FIG. 15 shows a variation on the present invention, wherein neck portion 16' is provided with an external screw-thread 16*a*', which engages with an internal screw-thread (not shown) within the lid 14'. Such a construction facilitates more accurate control of the neck 16' as it passes through the lid and into the receptacle 12'.

FIGS. 16*a* and 16*b* show a device 710 comprising a receptacle 712 and a lid 714, through which a rotatable neck 716 passes. The neck 716 comprises two alignment holes 770*a* and 770*b* in two different layers, which can be rotationally offset with respect to one another. By rotating the neck 716, the conduit 718 therein can be opened and closed to allow or prevent the flow of liquid therethough by either aligning or misaligning the holes 770*a* and 770*b*. This provides extra protection against inadvertent spillage of the contents of the device 710.

FIGS. 17*a* to 17*c* show a device 810 in the form of a jug-shaped receptacle 812, having a closure member 822 having sealing fins 830 around the circumference thereof, and a valve arrangement 832 in its centre, which is connected to an adjustment member 816. The valve arrangement 832 comprises two gas permeable (liquid impermeable) duckbill valves 832*a* and 832*b*. The sealing fins 830 are provided with at least one metallic portion 831 that comprises a ferromagnetic material. The device 810 is further provided with an external ring structure 880, which comprises a ring that encircles the receptacle 812 and is contact therewith. The ring structure 880 is provided with holding portions 882 that comprise magnetic members 884 therein.

The ring 880 is placed over the base of the receptacle 812 and is raised to the top thereof. The closure member 822 is then inserted into the receptacle and the magnetic members 884 engage with the ferromagnetic portion 831. The ring 880 is then lowered downwardly with respect to the receptacle 812 and the closure member 822 moves downwardly accordingly due to the magnetic connection between the closure member 822 and the ring 880. The air within the receptacle 812 passes through the first valve 832*a* as the closure member 822 moves towards the level of the liquid 858. Once the closure member 822 reaches the liquid level 858, increased resistance is encountered by the closure member 822. Thus, as the ring 880, is lowered further, the magnetic connection is broken and the ring 880 passes to the bottom of the receptacle. Because the air is removed from the receptacle 812 before the closure member 822 touches the liquid, the liquid is stored substantially 'air-free'.

When the ring 880 is raised up the receptacle again, the magnetic portions 831 are again engaged and air passes into the receptacle through valve 832*b* as the closure member 822 is raised. The closure member 822 can then be removed from the receptacle 812.

The arrangement of FIG. 17 may be operated by eye-sight and manually decoupled or may use a liquid impermeable valve 832*a*. In the former arrangement, the closure member 822 is lowered to the liquid level as shown in FIG. 17*b* using sight to judge when that level is reached. At that point, the device is either left with the magnetic forces engaged, rather than lowering it further to dislocate the ring 880, or the magnetic force is manually decoupled. An electromagnetic with a switch to operate it may be provided for this purpose.

Figure 18:
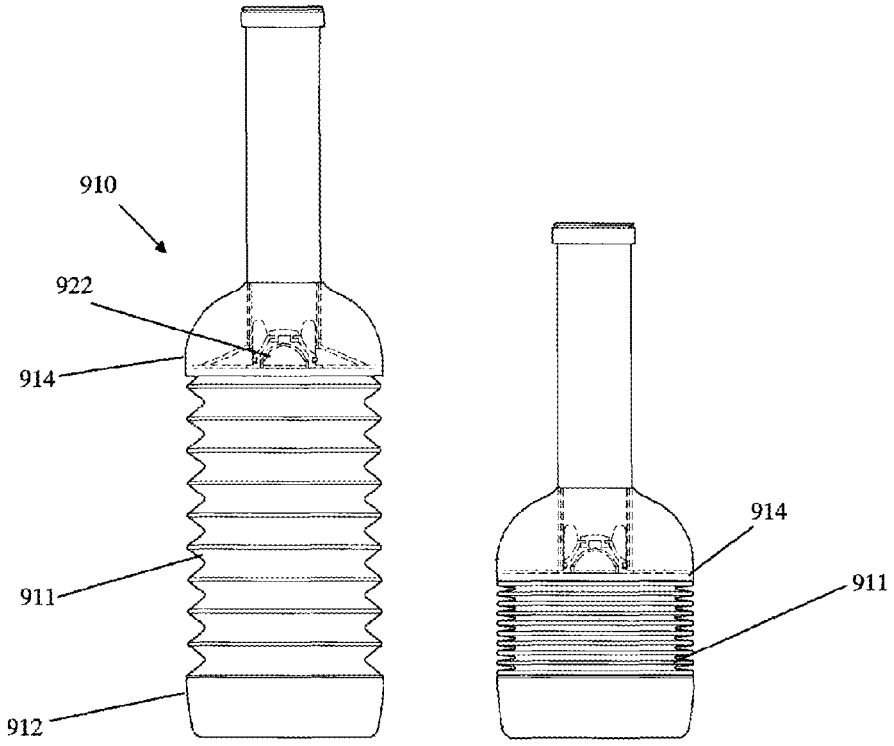
FIG. 18 shows a further embodiment of the present invention.

FIG. 18 shows a device 910 wherein the closure member 922 is fixed in position and the receptacle 912 is able to be collapsed upon itself to bring the closure member 922 into contact with the liquid contained within the receptacle 912. The receptacle is able to repeatably collapse and be uncollapsed by way of a corrugated of the side wall 911. In such an arrangement the closure member 922 is connected to the internal wall of the receptacle 912 and is moved with the top of the receptacle 914 relative to the liquid level.

FIGS. 19*a* to 19*d* show a device 1010 having a closure member 1022 with an outlet aperture 1036 therethrough. As with the other embodiments, the closure member 1022 is provided with a sealing portion 1030 about its periphery to substantially seal the closure member against the receptacle 1012 in which it is placed. The device 1010 is provided with a valve cartridge 1090 comprising a ball float 1038, a valve float seat 1039, which extends below the bottom of the closure member 1022, and a valve section 1032. In the form for of a ring with a hole through its middle. The valve seat 1039 is provided with perforations (or apertures) 1092 about its upper circumference, in close proximity to the closure member 1022.

The ball float 1038 is positioned within the seat 1039 and below the valve section 1032 and it can move vertically (longitudinally with respect to the bottle) within the seat from a first position resting on the seat to a second position wherein the float valve is against the valve section 1032 and prevents the passage of fluid therethrough. Additionally, in the second position, fluid cannot pass through the apertures 1092 and through the valve section 1032.

Figure 19A:
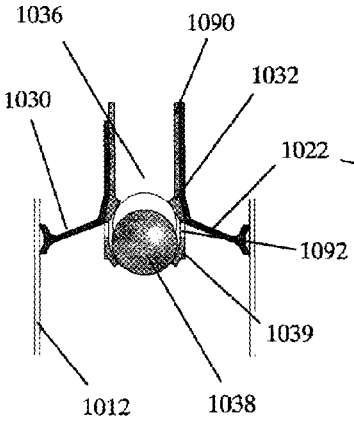
FIGS. 19*a* to 19*d* show a further embodiment of the present invention.

When the closure member 1022 is raised from any liquid in the receptacle 1012, it rests in the first position in the valve seat 1030, as shown in FIG. 19*a*. When the closure member 1022 is lowered and the float contacts the liquid in the receptacle 1012, it floats on the liquid and raises to the second position, shown in outline in FIG. 19*a*.

Figure 19B:
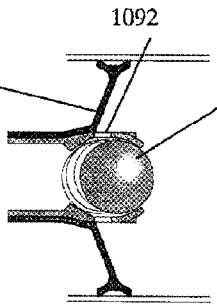
Figure 19C:
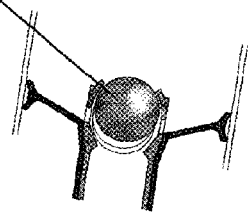

Upon pouring the liquid out of the receptacle 1012, the closure member is raised away from the liquid in the receptacle 1012 and the ball float 1038 returns to the first position. The receptacle 1012 is then tilted and as the ball float 1038 contacts the liquid it floats on the liquid, leaving the aperture 1036 clear, as shown in FIGS. 19*b* and 19*c*. Liquid passes through the perforations 1092 to avoid the ball float 1038 and it can pass through the aperture 1036 and out of the receptacle 1012. Because the ball float 1038 floats on the liquid, when the receptacle is off vertical and the closure member is away from the surface of the liquid, the liquid is able to pass underneath the ball float 1038 and out of the receptacle. However, when the closure member 1022 is in a lowered position the ball float 1038 is held in the valve section 1032 and so prevents the passage of liquid through the aperture 1036.

Figure 19D:
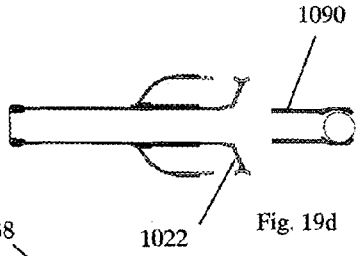
Figure 20A:
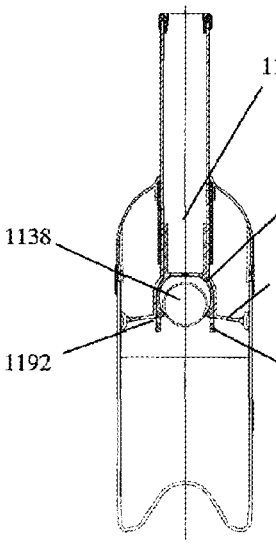
FIGS. 20*a* to 20*d* show another embodiment of the present invention.
Figure 20B:
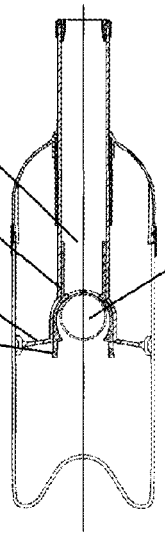
Figure 20C:
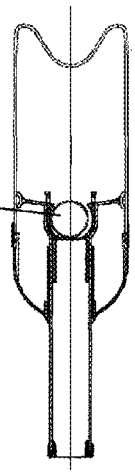
Figure 20D:
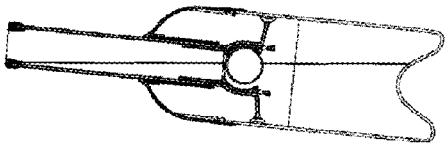

The cartridge 1090 may be removed from the closure member 1022, as shown in FIG. 19*d*.

FIGS. 20*a* to 20*d* show an arrangement similar to that shown in FIGS. 19. However, in this embodiment, the cartridge 1190 is almost fully contained within the closure member 1122. The diameter within the valve seat 1139 is larger than that of the ball float 1138, which allows the ball float 1138 to float up within the seat 1139, when the receptacle 1112 is tilted, and thus allow liquid to pass under the float 1138 and through the aperture 1136. However, when the ball float 1138 is in the second, closed, position, no liquid is able to pass around the ball float 1138.

Figure 21A:
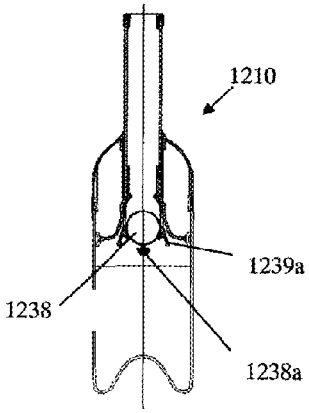
FIGS. 21*a* to 21*c* show a different embodiment of the present invention.
Figure 21B:
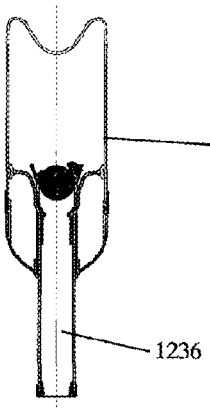
Figure 21C:
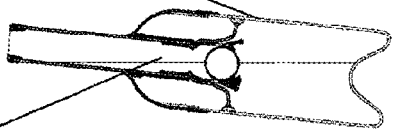

FIGS. 21*a* to 21*c* show an arrangement similar to that shown in FIGS. 20. In this embodiment, the float valve 1238 is provided with an anchor section 1238*a* and the valve seat 1239 is provided with anchor recesses 1239*a*. As the receptacle 1212 is rotated, the ball float anchor 1238*a* keeps the float in a relatively stationary position until the anchor section 1238*a* engages the anchor recess 1239*a*. When the anchor 1238*a* engages the recess 1239*a*, the ball float 1238 is retained in its first position. Therefore, even when the receptacle is upended, the ball float 1238 is retained in the first position and liquid is able to pass around the ball float 1238 and exit the receptacle 1212 through the aperture 1236. The receptacle 1212 is then returned to a substantially vertical position and the anchor 1238*a* disengages from the recess 1239*a* and the ball float 1238 is able to float into the second position when it comes into contact with the liquid in the receptacle 1212, thereby closing the valve of the device 1210.

Figure 22A:
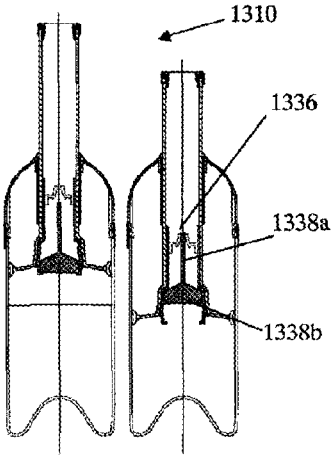
FIGS. 22*a* to 22*c* show a further embodiment of the present invention.
Figure 22C:
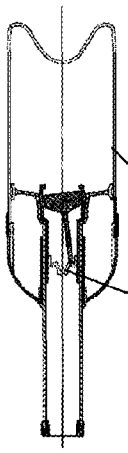
Figure 22B:
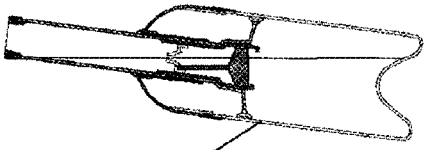

FIGS. 22*a* to 22*c* show a device 1310, which is similar in construction to that shown in FIG. 19. However, this embodiment is provided with a large-bottomed stick float 1338, rather than a ball float. The float 1338 is shaped with an elongate section 1338*a* at its top end and a large section 1338*b* at its lower end. The valve section 1332 is adapted to have a recess 1336 that can be plugged by the elongate section 1338*a* of the float 1338 when the float is in its second position. When the closure member 1322 is raised, the elongate section 1338*a* disengages from the valve recess 1336. Upon tilting the receptacle 1312, the lower end of the float 1338 floats higher than the elongate portion and so the float 1338 tips to one side and the tip of the elongate section 1338*a* is caught on the underside of the valve section 1332. The valve 1332 is provided with a small protrusion to retain the float 1338 in the lower side of the valve 1332. This prevents the float 1338 from re-entering the recess 1336 and so the liquid is able to pass around the float 1338 and through the recess 1336.

When the closure member 1322 is raised and/or the receptacle 1312 is returned to an upright position, the elongate tip of the float 1338 disengages and returns to its first position, ready to float upon contact with the liquid in the receptacle 1312 and the re-enter the recess 1336.

Figure 23A:
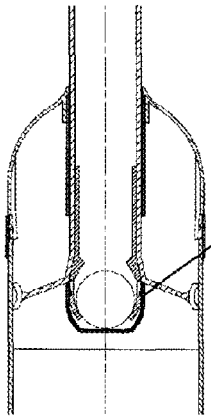
FIGS. 23*a* and 23*b* show a variation on the valve arrangement according to the present invention.
Figure 23B:
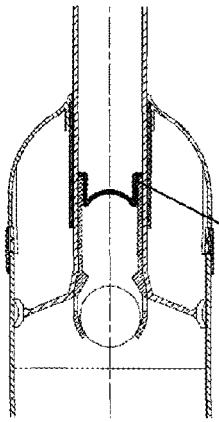

FIGS. 23*a* and 23*b* show a cartridge arrangement according to the embodiment shown in FIG. 19, wherein a filter 1494 is applied to the top of the cartridge (FIG. 23*a*) and the bottom of the cartridge (FIG. 23*b*). The filter prevents the passage of sediment and other solids from within the receptacle through the valve.

Figure 24:
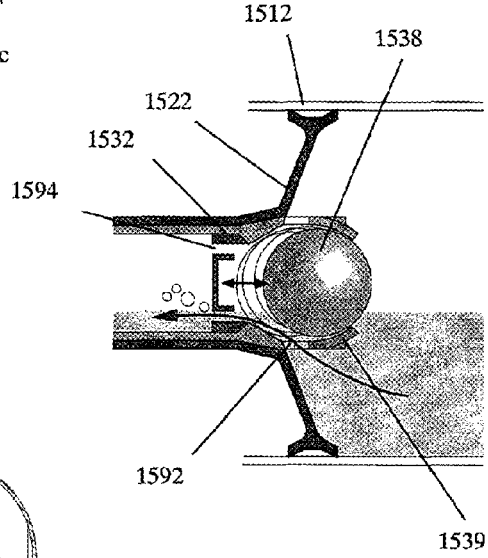
FIG. 24 shows an aeration system in accordance with the present invention.

FIG. 24 shows an arrangement as shown in FIGS. 19, wherein aeration of the contents occurs upon the liquid passing through the valve system. The valve section 1532 is formed as a disc having vent holes, or perforations, 1594 in its surface. This allows the ball float 1538 to move back and forth within the seat 1539 and the movement mixes oxygen with the liquid as it is poured. In respect of wine, this gives a richer, full-bodied taste by opening up the flavours and aromas.

Figure 25:
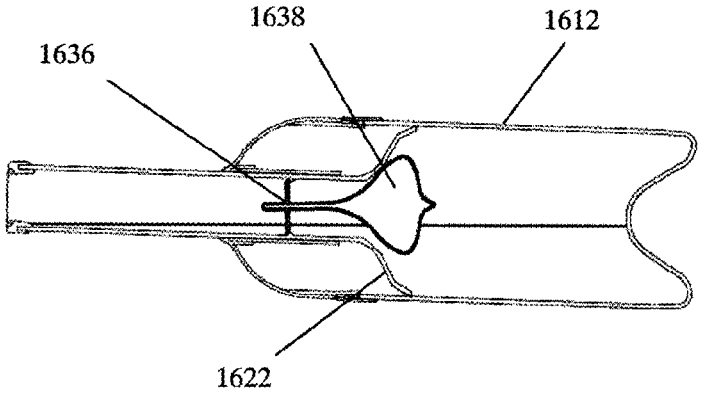
FIG. 25 shows another embodiment of the present invention.

FIG. 25 shows a further embodiment of the present invention comprising a closure member 1622, wherein a bulbous, or 'onion-shaped', float 1638 is provided in the receptacle. The narrow top of the float is sized to close the aperture 1636, when floating on the liquid in the receptacle 1612 and the lower larger end blocks the lower end of the closure member 1622 when floating on the liquid and the closure member 1622 is lowered with the receptacle 1612 in a generally upright position. On pouring, the lower end of the float 1638 floats high enough for the liquid to pass under the float 1638.

Figure 26:
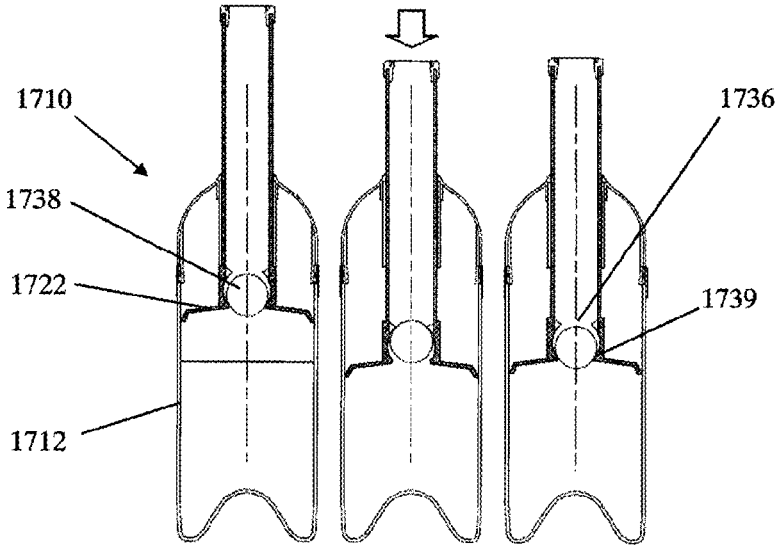
FIG. 26 shows a further embodiment of the present invention.

FIG. 26 shows another embodiment of the present invention and a series of movements associated with this embodiment. The second figure of the series shows the point at which the user is pressing down and the float 1738 is raised by the liquid in the receptacle 1712 as a result of the pressure and the buoyant nature of the float 1738. The upper part of the valve 1732 seals against the float 1738 whilst pressure is applied. The third figure of the series shows a position when the user is no longer applying pressure to the device 1710. The closure member 1722 and valve section 1732 relax and the liquid level drops accordingly (approximately 3 mm). The float 1738 subsequently also drops (approximately 3 mm) and then rests on the lower part of the valve seat 1739, thereby sealing the aperture 1736.

FIGS. 27*a* and 27*b* show a device 1810 comprising a closure member 1822 having a sealing portion 1830 around its periphery. The centre of the closure member 1822 comprises a series of apertures 1841. The closure member comprises a collar on its upper surface into which is positioned a neck part 1818. The neck part 1818 comprises a lower surface with apertures 1836 therein and blocking sections there between.

The neck part 1818 can be rotated in the collar of the closure member 1822 such that the apertures 1836 in the neck part 1818 align with the apertures in the closure member 1822 and thereby allow fluid communication between the two parts. The neck part 1818 may also be rotated such that the blocking sections between the apertures 1836 are aligned with the apertures 1841 of the closure member 1822. In such an arrangement fluid communication between the inside of the device 1810 and the neck part 1818 is prohibited. The sealing portion 1830 comprises a material that creates a frictional connection between the receptacle 1812 and the closure member 1822 such that the closure member 1822 does not rotate upon rotation of the neck part 1818.

This device 1810 is twisted to a first, open position, with the apertures of the neck part 1818 and the closure member aligned. The closure member 1822 is then lowered to the surface of the contents of the receptacle 1812 using sight to judge when the closure member 1822 is at the level of the liquid within the device 1810. The neck part 1818 is then rotated to align the blocking members between the apertures 1836 with the apertures 1841, thereby closing the device 1810 to the air. This prevents the air getting to the contents of the receptacle 1812. Any suitable number, sized and shaped apertures may be used.

FIG. 28 shows a further embodiment of the present invention, wherein the device 1910 comprises a receptacle 1912 having a lid 1914 and a closure member 1912. The lower end of the closure member 1922 comprises a skirt and a seal around its periphery.

In the centre of the closure member 1922 is provided a threaded float carriage 1943, internal to which is a float 1938 that can be completely accepted within the float carriage 1943. The float comprises apertures around its periphery that allow air to pass from within the receptacle 1912 out of the neck part 1918. The float carriage is able to move longitudinally within the closure member 1922 such that it can extended and retracted into the closure member 1922. The float carriage 1943 further comprises apertures around its circumference that allow fluid communication through the top of the device 1910. Upon rotating the neck part 1918 of the device 1910, the closure member grips the internal wall of the receptacle 1912 and stays in place, whilst the float carriage is raised and lowered due to the threads within the closure member 1922.

The device can be operated from a first position with the float carriage retracted into the closure member 1922, by lowering the closure member 1922 towards the liquid in the receptacle 1912. Air above the liquid in the receptacle passes through the apertures of the float and through the neck part 1918. Eventually, the float 1936 comes into contact with the upper surface of the liquid within the receptacle 1912. At that point, it raises within the carriage and is accepted therein so that the apertures no longer permit fluid communication with the outside of the receptacle. The device 1910 thus removes the air from above the liquid and seals it.

To remove liquid from within the device 1910, the neck part is rotated to extend the float carriage and open the apertures about its periphery. The closure member 1922 can then be raised and the liquid poured through the apertures of the float carriage 1943 and out of the device 1910.

The end of the conduit of the neck may be provided with an air escape mechanism so that a user cannot block it off whilst pushing down on the neck, for example with their palm. Such a mechanism may be in the form of apertures adjacent to the top end of the neck.

The valve, and/or other parts, may be coated with an elastically yieldable material, such as a silicone substance, so that the seals are more secure.

Locating recesses may be used to ensure that the parts are positioned correctly. These may work with O-ring seals so that the parts 'snap' into place to give tactile feedback to a user and to ensure that the parts are correctly located before, for example, pouring the contents of the receptacle from the device.

The receptacle is intended to be closed at its lower end such that the contents are intended to be removed from the device from its upper end.

The closure member and/or the valve arrangement may be detachable from the end of the neck so that it can be easily cleaned. Further parts may be readily disconnected to assist with cleaning or replacing parts. The receptacle and/or other parts may comprise glass material.

Numerous other variations and modifications to the illustrated construction may occur to the reader familiar with the art without taking the device outside the scope of the present invention.

It may be desirable to combine a gas permeable membrane that is non-permeable to liquid with a valve comprising a blocking member to reduce the likelihood of leaking.

The device may be provided with an integral, or removable, aeration device in order to improve the flavour of the liquid contained within. For example, on a wine decanter in the form of a bottle, the device may have an aeration device within the conduit in the neck so that as the wine is poured it is aerated to develop the flavours.

The device may be provided with one or more electric motors to automate operation. For example, the closure member may be raised and lowered using an electric motor, the motor being set to turn off once a predetermined amount of resistance is felt in order to prevent the motor from burning out.

The device may further comprise a stopper in the end of the neck conduit to seal the device as one might a regular bottle.

The device shown in FIGS. 17*a* to 17*c* may be operated without the magnetic arrangement and it may be desirable to extend the adjustment section to make it easier to operate.

Whilst some devices have been shown without cartridges for the valve, such an arrangement may be substituted with a cartridge arrangement. Likewise, those shown with a cartridge arrangement may be substituted with an integral non-cartridge arrangement. Additionally, where a cartridge is used, the cartridge may be yieldable to enable the float to be removed from the cartridge, for example, for cleaning and/or inspection.

The receptacle may be sized between 150 ml and 1000 ml.

In at least some embodiments of the present invention, the liquid is poured through the valve and gas exits through the valve, with no other apertures through which the liquid/air may pass. The liquid passes around the float of the float valve and through the aperture. The closure member does not need removing to pour liquid out of the receptacle.

The valve section may comprise a silicone and/or rubber material. This provides some flex and recoil, which, when the top is lifted, pushes the float back into its seat. This breaks the seal and reduces the risk of the float being stuck in a closed position.

The invention claimed is:

1. A storage device comprising:

a receptacle comprising an internal surface; and, a movable closure member, the closure member comprising:

a seal about a periphery of the closure member sealing the closure member against the internal surface of the receptacle, and a valve within the closure member periphery, wherein the closure member is adapted to move within the receptacle with the closure member periphery substantially continually in contact with the internal surface of the receptacle, and wherein, when in an open position, the valve allows flow of fluid from within the receptacle through the valve, and when in a closed position, the valve prevents flow of liquid from within the receptacle;

wherein the receptacle comprises a substantially closed lower end; and, the device being characterized in that the movable closure member comprises an aperture and the valve comprises a blocking member that, in the closed position, is received within the aperture and closes the aperture to the passage of fluid, and in that the blocking member comprises a float that, when the float comes into contact with a liquid contained within the receptacle, floats thereupon and blocks the aperture of the closure member.

2. A device according to claim 1, wherein, when the movable closure member is positioned at a top level of the liquid, the closure member self-limits further motion towards the liquid and cannot be moved any lower.

3. A device according to claim 1, wherein the closure member comprises an adjustment section for adjusting a position of the closure member within the receptacle.

4. A device according to claim 3, wherein the adjustment section is integral with the closure member.

5. A device according to claim 4, wherein the adjustment section comprises a conduit therethrough, thereby allowing fluid communication from within the receptacle, through the valve and through the adjustment section to outside the device.

6. A device according to claim 1, wherein the valve comprises a seat portion in which the float rests when in an upright position; and, wherein the seat extends below a lower surface of the closure member peripheral seal.

7. A device according to claim 6, wherein the seat portion comprises a base and a circumference, wherein the base or the circumference comprises at least one aperture.

8. A device according to claim 7, wherein the at least one aperture comprises a filter.

9. A device according to claim 1, wherein the float comprises a ball float.

10. A device according to claim 8, wherein the at least one aperture has tapered sides.

11. A device according to claim 1, wherein the device is provided with a top portion that fits onto and substantially closes a top of the receptacle.

12. A device according to claim 11, wherein fluid communication is allowed between the inside of the receptacle the outside of the top portion.

13. A device according to claim 1, wherein the storage device is a decanter for storing wine, sparkling wine, soft drinks, or oil.

14. A device according to claim 1, wherein the float is adapted to have a density lower than the liquid.

15. A device according to claim 1, wherein the float is not urged onto the seat by a spring.

* * * * *